US007258231B1

(12) United States Patent
Wertz et al.

(10) Patent No.: US 7,258,231 B1
(45) Date of Patent: Aug. 21, 2007

(54) INCREASING CARGO LOADING OF VEHICLES

(75) Inventors: Robert O. Wertz, Mountain Home, ID (US); Charles A. Vatcher, Victorville, CA (US); Charles M. Mann, Quartz Hill, CA (US); Udo Kaltenthaler, California, CA (US)

(73) Assignee: United States of America as represented by the Secretary of the Air Force, Washington, DC (US)

( * ) Notice: Subject to any disclaimer, the term of this patent is extended or adjusted under 35 U.S.C. 154(b) by 195 days.

(21) Appl. No.: 10/147,711

(22) Filed: May 17, 2002

(51) Int. Cl.
*B65D 19/00* (2006.01)
*B65D 19/38* (2006.01)

(52) U.S. Cl. ..... 206/386; 108/53.5

(58) Field of Classification Search ..... 206/386, 206/600, 821; 108/53.5, 106, 107, 55.1, 108/53.1, 56.1, 51.11, 186, 57.33; 220/1.5, 220/503, 4.26; 244/118.1, 118.2
See application file for complete search history.

(56) References Cited

U.S. PATENT DOCUMENTS 3,327,654 A * 6/1967 Duncan et al. ..... 108/53.5
3,401,814 A * 9/1968 Chiswell et al. ..... 220/1.5
4,174,045 A * 11/1979 Heller et al. ..... 220/1.5
4,366,905 A * 1/1983 Forshee ..... 206/600
5,289,933 A * 3/1994 Streich et al. ..... 220/1.5
5,413,224 A * 5/1995 Marron et al. ..... 206/600
5,755,163 A * 5/1998 Coats ..... 108/53.5
6,402,167 B1 * 6/2002 Calleja ..... 108/55.1
2003/0150769 A1 * 8/2003 Lau ..... 206/600

FOREIGN PATENT DOCUMENTS

EP 52529 A1 * 5/1982

* cited by examiner

*Primary Examiner*—Mickey Yu
*Assistant Examiner*—J. Gregory Pickett
(74) *Attorney, Agent, or Firm*—AFMCLO/JAZ; Thomas C. Stover

(57) ABSTRACT

Provided is a bi-level pallet assembly wherein a pallet is mounted over another on posts supported by corner braces or on posts supported by panels therebetween so that the two pallets are married bunk-bed style together. Cargo is stored on each of the upper and lower pallets and driven by a forklift onto a cargo aircraft to double the normal cargo carrying capacity of such aircraft by utilizing formerly unused space above the first level of cargo. The bi-level pallet assembly of the invention can potentially double the cargo capacity of such aircraft and free up cargo aircraft to meet other demands with a considerable savings of dollars over traditional deployment costs.

8 Claims, 3 Drawing Sheets

INCREASING CARGO LOADING OF VEHICLES

STATEMENT OF GOVERNMENT INTEREST

The invention described herein may be manufactured and used by or for the Government for governmental purposes without the payment of any royalty thereon.

RELATED APPLICATIONS

None

FIELD OF THE INVENTION

This invention relates to increasing the cargo capacity of vehicles, particularly aircraft.

BACKGROUND OF THE INVENTION

The current cargo aircraft design limits the amount of cargo an air lifter can carry because there is presently no way to utilize the 'unused' space above the cargo secured to the aircraft floor during transport (for a C-17 this 'unused' space equates to over 32,000 cu ft).

The cargo is typically loaded on standard 463 L cargo pallets in the C-17 and the loaded pallets occupy only about 8,222 cu ft for about 18 pallet positions. If more pallets could be loaded into the C-17, the cargo carrying ability of such aircraft would be dramatically increased within its airlifting capability and the number of such aircraft required for deployment of equipment greatly reduced. This would free up a significant number of transport aircraft to meet other mission or commercial demands.

Prior art references have been reviewed such as U.S. Pat. No. 5,755,163 to Coats (1998) which discloses upper platforms balanced on jacks, which jacks clamp on a lower frame, but no references have been found which suggest a stable assembly to solve the above inefficient cargo airlifting system.

Accordingly there is need and market for an improved cargo airlift system, (which employs a greater percentage of aircraft interior space), that overcomes the above prior art shortcomings.

There has now been discovered a shipping system which greatly increases the amount of cargo that can be airlifted in previously underutilized cargo aircraft, such as the C-17.

SUMMARY OF THE INVENTION

Broadly, the invention provides an improved cargo airlifting system, in which the cargo carrying capability of an aircraft is increased by more effectively using the cargo space thereof.

The invention also provides a pallet assembly for increasing cargo capacity in aircraft which includes, a) a lower pallet for holding cargo thereon, b) a plurality of posts or uprights mounted to the lower pallet and extending thereabove a desired height and c) an upper pallet mounted to upper portions of the posts for holding cargo thereon, so as to store and ship cargo on at least two levels.

Per the present invention, loaded standard pallets are stacked "bunk bed" style together on at least two levels to, e.g., effectively double the amount of equipment that can be transported in the same cargo-carrying aircraft.

Definitions:

An upper pallet mounted above the lower pallet defines the bi-level pallet assembly of the invention.

By: "cargo loading means" as used herein, is meant any reasonable conveyance of cargo onto a pallet such as by a forklift, or other wheeled carrier, such as a dolly, wheelbarrow, by hand or hands, as well as by pushing cargo that has its own wheels.

Thus, employing standard pallets and a fork lift, a straight-forward drive-on, drive-off system can load two levels of equipment onto airlifters (e.g., C-5, C-17, C-141, and C-130) on the bi-level pallet assembly embodiment of the invention, to greatly reduce the number of transport aircraft required to deploy a desired amount of equipment.

The savings on such multi-level pallet loading in a cargo aircraft can be considerable. For example, for a C-17 aircraft the cost of one level loading is over $7,000 per pallet position or footprint. Such an aircraft with 18 pallet positions can cost over $136,000 each way or over $272,000 round trip, thus the above inventive system, utilizing two pallet levels, can save up to $272,000 for each deployment.

Accordingly, the multi level pallet assembly of the invention can more effectively utilize its deployment footprint in an airlifter by using the normally unused cargo space above the cargo secured to the floor of the aircraft. Thus the inventive system can free up more cargo aircraft to meet other demands, while saving millions of dollars over traditional deployment costs. The inventive concept applies to commercial as well as military aircraft.

BRIEF DESCRIPTION OF THE DRAWINGS

The invention will become more apparent from the following detailed specification and drawings in which.

DESCRIPTION OF PREFERRED EMBODIMENTS

Figure 3:
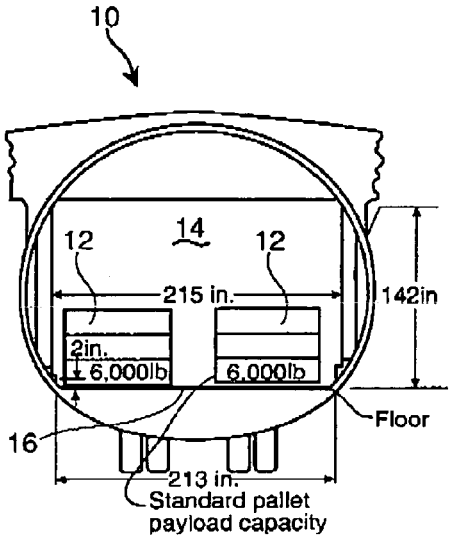
Fig. 3 Prior Art
FIG. 3 is a fragmentary cross-sectional, schematic elevation view of cargo loaded in such aircraft per the prior art.

Referring now to the drawings, the standard way of airlifting cargo 12 is to load same on an aircraft 10, such as a C-17, e.g., by a fork lift, on one level, the aircraft floor 16, leaving considerable unused space 14 above the cargo 12, as shown or indicated in FIG. 3.

Figures 7, 8, 9, 10, 11:
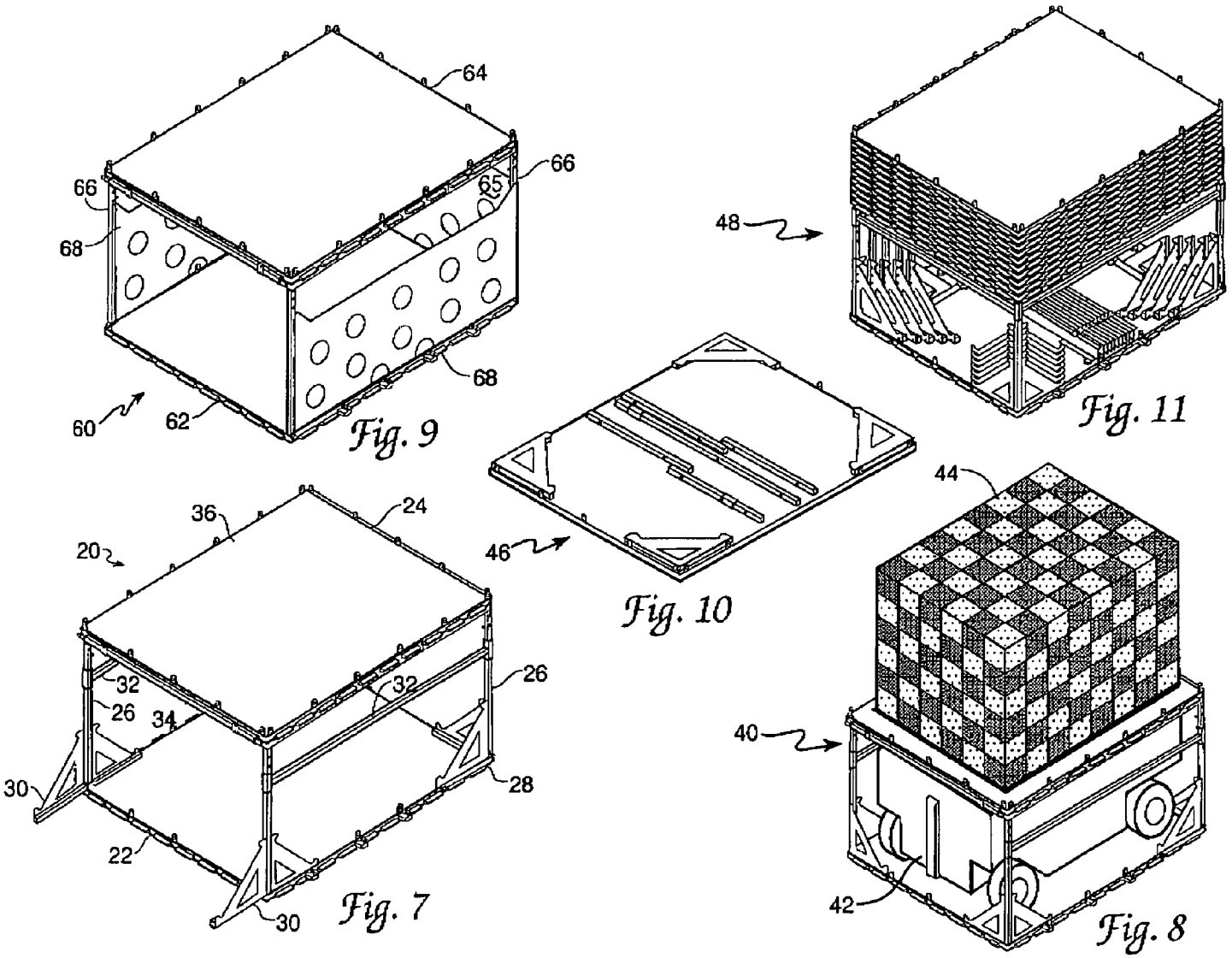
FIG. 7 is a perspective view of a second embodiment of the bi-level pallet assembly of the invention, open to a cargo loading means.
FIG. 8 is a perspective view of such second embodiment of the invention, loaded on both levels.
FIG. 9 is perspective view of yet another embodiment of the bi-level pallet assembly of the invention.
FIG. 10 is a perspective view of components of the pallet assembly of FIGS. 7 & 8 folded flat and FIG. 11 is a perspective view of a plurality of components of the pallet assembly of FIGS. 7, 8, & 10 in stacked array.

Since in a C-17 such unused space equates to over 32,000 cubic feet, the bi-level pallet assembly of the invention was devised to more effectively use such space and to potentially double the amount of cargo that can be transported in a C-17 or other aircraft. One embodiment 20 of the bi-level pallet assembly of the invention 20 is shown in FIG. 7, having a pair of pallets 22 and 24 separated by posts 26, which are braced by corner supports 28 and 30, with further support provided by cross bars 32 and pallet edge bars 34 and 36 for pallet 24, with similar bars (not shown) for pallet 22 around its periphery, as shown or indicated in FIG. 7. The pallet edge bars can engage tabs on an aircraft floor to anchor the lower pallet in place, while tie downs can secure cargo on both levels of the inventive bi-level pallet assembly over such lower pallet.

In the embodiment of FIG. 7, corner supports 30 are in the open position to permit entry onto the lower pallet 22 by a loading means such as a fork lift and once loaded, such angle supports can be closed in the manner of corner supports 28. Also, the upper pallet 24 can be loaded with cargo, as shown in FIG. 8. That is, in FIG. 8, bi-level pallet assembly 40 is loaded with cargo 42 on the first (or lower) level and cargo 44 on the second (or upper) level.

Parts which can be assembled into the bi-level pallet assembly of FIGS. 7 & 8, are shown as components 46 and 48 respectively, in FIGS. 10 and 11. That is, the components 46 of FIG. 10 are folded flat for storage and transport.

Figure 5:
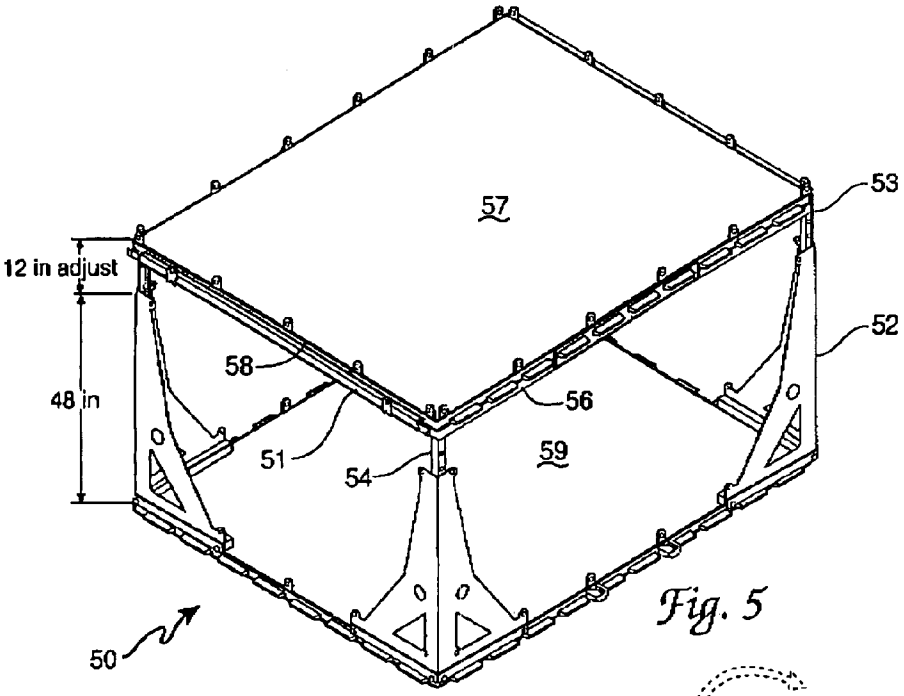
FIG. 5 is a perspective view of one embodiment of a bi-level pallet assembly of the invention.

Another embodiment of the bi-level pallet assembly of the invention is shown in FIG. 5 which has higher corner supports 52 and adjustable height upright posts 54 and also panel edge bars 56 & 58, around both upper and lower pallets, as shown in FIG. 5 but no intermediate crossbars such as crossbars 32 shown in FIG. 7.

Figure 6:
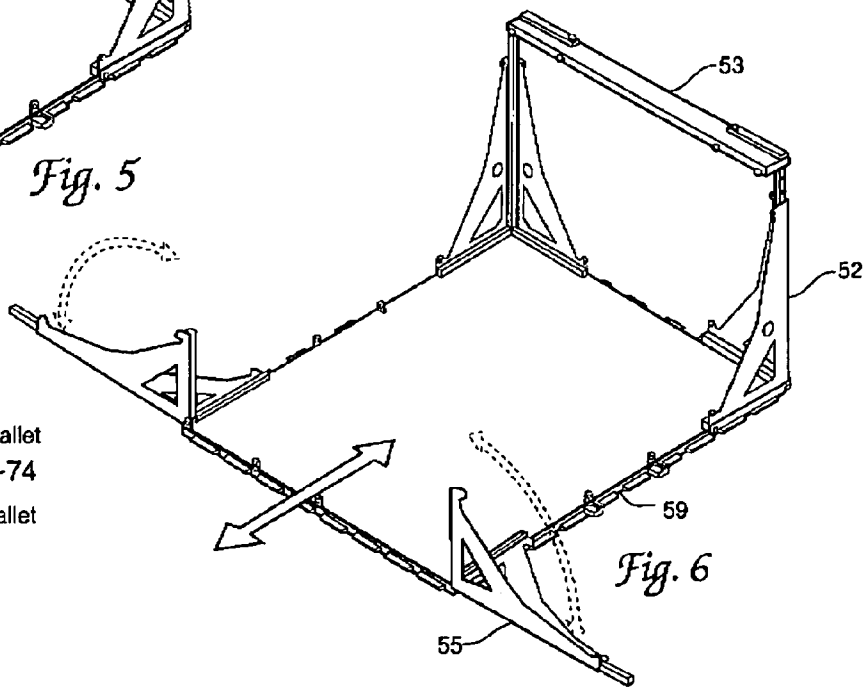
FIG. 6 is a perspective view of a portion of the bi-level structure of FIG. 5 in an open position for cargo loading means.

However, the bi-level pallet assemblies of FIGS. 5,7 & 9, preferably have added supports beneath a pair of upper pallet edges in the form of, e.g., end rails 51 & 53, as shown in FIGS. 5 & 6, which rails also brace the corner posts and corner supports adjacent thereto.

Also the corner supports 52 can open to a horizontal position 55 for ease of loading cargo on the bottom pallet 59, as shown in FIG. 6.

In another embodiment, the bi-level pallet assembly of the invention can be a paneled structure 60 having pallets 62 and 64 (with pallet edge bars around the edges thereof and a pair of end rails under pallet 64 as above described, but not shown) and with posts 66, braced by apertured panels 65 & 68, as shown in FIG. 9. Once the lower pallet 62 is loaded through the open end, a fourth panel (not shown) can be installed to close such end and rigidify the pallet assembly or paneled structure 60 of FIG. 9.

Figure 1:
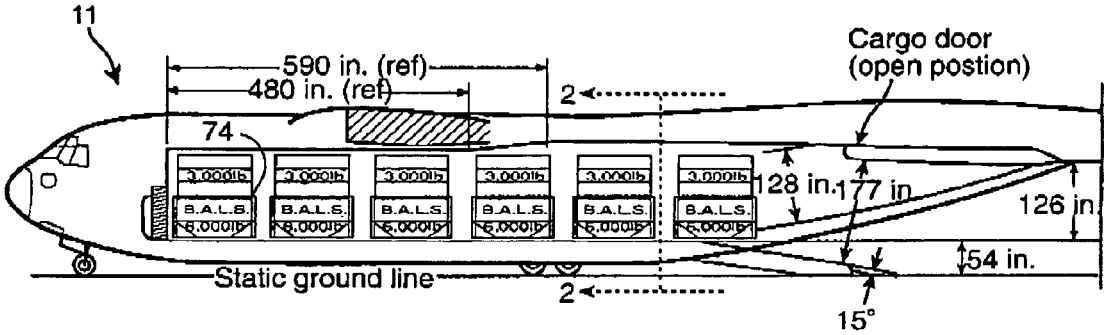
FIG. 1 is a schematic elevation view, partly in section, showing the airlift cargo system of the present invention.
Figure 2:
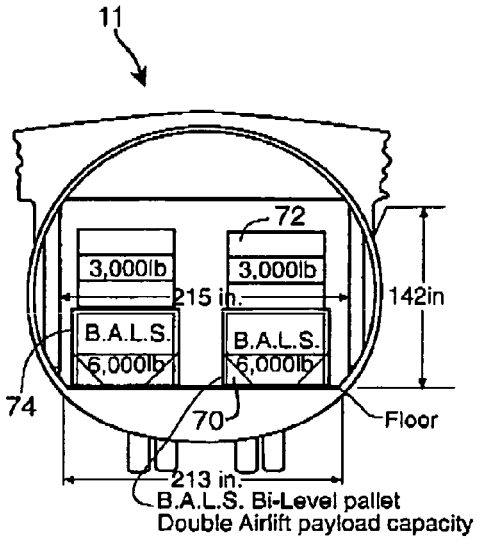
FIG. 2 is a fragmentary cross-sectional schematic elevation view of the loaded aircraft of FIG. 1 taken on lines 2-2, looking in the direction of the arrows.

Thus the bi-level pallet assembly of the present invention, e.g., pallet 74, can hold lower level cargo 70 and upper level cargo 72, more effectively utilizing the cargo space of a C-17 or other aircraft 11, as shown in FIGS. 1 & 2.

Figure 4:
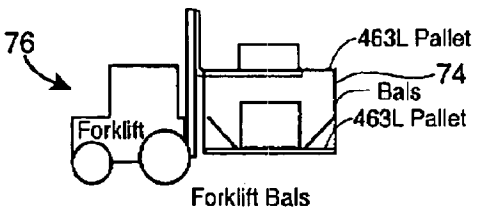
FIG. 4 is an elevation schematic view of mobile means to load bi-level pallet assemblies of the invention onto aircraft.

The bi-level pallets embodying the invention, with each level loaded, can be readily put aboard the aircraft 11 by a drive-on system such as the forklift 76, shown in FIG. 4. Likewise the aircraft 11 can readily be unloaded by a similar drive-off system at the cargo's destination.

The bi-level pallet assembly of the invention can employ various pallets such as standard cargo pallets or other platforms, which are married, bunk-bed style together, utilizing various support components such as corner braces, posts, rails and bars. The corner braces can take various shapes as indicated, e.g., in FIGS. 5 and 7 of the drawings and the other support components can take various shapes in cross-section, such as tubular, channel, angular, rounded, hollow or solid or combination thereof, as desired within the scope of the invention.

Desirably, such corner braces, posts, rails and bars are of metal but can be of other material, such as wood, plastic or a composite of wood or plastic, for lighter loads, within the scope of the invention.

Also per the invention, the corner braces can be replaced with corner posts 66, when employing panel support members 65 & 68 as uprights, as shown in FIG. 9. Such panels can, of course, be apertured per FIG. 9 or not, as desired, within the scope of the invention.

The above bi-level pallets of the invention for convenience, can be designated "tube side" as to the embodiments shown in FIGS. 5, & 7 and "panel side" as to the embodiment shown in FIG. 9.

Also, the bi-level pallet assembly of the invention can employ various methods of attachment of the corner braces to the pallet; such as bolts, pins, cam locks and levers, as desired, within the scope of the invention.

Thus the bi-level pallet assembly of the invention can reduce the deployment footprint by utilizing formerly unused cargo space above the one level cargo normally secured to the floor of the aircraft. Additionally, the system can free up more cargo aircraft to meet other demands, while saving millions of dollars over traditional deployment costs.

Further such bi-level pallet assembly can be applied to commercial cargo aircraft as well as military aircraft, with suitable modifications to fit the storage requirements of the respective aircraft.

Also the pallet assembly herein can include three or more pallet levels, if desired, in a multi-level pallet assembly, within the scope of the invention.

What is claimed is:

1. A pallet assembly for increasing the amount of cargo shipped in an aircraft comprising, a) a lower pallet for holding cargo thereon, which pallet has an unobstructed lower surface for readily loading cargo thereon, b) a plurality of posts mounted to said lower pallet and extending thereabove a desired height, c) an upper-pallet mounted to upper portions of said posts to provide a stable and substantially unobstructed upper surface for readily loading cargo thereon so as to store and ship cargo on at least two levels, at least some of said posts being mounted at a plurality of corners of said lower pallet and being reinforced in at least two corner directions by spreading corner braces mounted thereto which braces, however, can pivot out of the path of the cargo being loaded on such lower pallet.

2. The assembly of claim 1 wherein said pallets are separated by said posts in a bi-level arrangement so as to potentially double the cargo-carrying capacity of an aircraft.

3. The assembly of claim 1 wherein said posts are tubular, angular or solid with braces at a plurality of corners.

4. The assembly of claim 1 wherein said pallets are rectangular.

5. The assembly of claim 1 wherein at least some of the edges of said upper and lower pallets have spaced tabs adapted to engage support means.

6. The assembly of claim 1 wherein rails support at least some of the edges of said upper pallet.

7. The assembly of claim 1 where said pallets are mounted bunk-bed style in a bi-level pallet assembly and readily transported by mobile means on to and off an aircraft.

8. The assembly of claim 1 wherein one or more of said corner braces are pivotable out of the path of cargo loading of said lower pallet and thereafter are returnable to their previous positions.

* * * * *